US010201763B2

(12) United States Patent
Pepin

(10) Patent No.: US 10,201,763 B2
(45) Date of Patent: Feb. 12, 2019

(54) SLOT CAR TRACK CLEANING DEVICE

(71) Applicant: Norman Napaul Pepin, Sherwood Park (CA)

(72) Inventor: Norman Napaul Pepin, Sherwood Park (CA)

( * ) Notice: Subject to any disclaimer, the term of this patent is extended or adjusted under 35 U.S.C. 154(b) by 142 days.

(21) Appl. No.: 15/416,136

(22) Filed: Jan. 26, 2017

(65) Prior Publication Data

US 2017/0239690 A1 Aug. 24, 2017

Related U.S. Application Data

(60) Provisional application No. 62/298,520, filed on Feb. 23, 2016.

(51) Int. Cl.

| | |
|---|---|
| ***A63H 19/15*** | (2006.01) |
| ***B08B 1/00*** | (2006.01) |
| ***E01H 8/00*** | (2006.01) |
| ***A63H 18/16*** | (2006.01) |

(52) U.S. Cl.

CPC ..... *A63H 19/15* (2013.01); *A63H 18/16* (2013.01); *B08B 1/006* (2013.01); *B08B 1/008* (2013.01); *E01H 8/00* (2013.01)

(58) Field of Classification Search

CPC .. A63H 19/15; E01H 8/10; E01H 8/12; B08B 1/006; B08B 1/008

USPC ..... 104/279, DIG. 1; 105/1.5, 238.2

See application file for complete search history.

(56) References Cited

U.S. PATENT DOCUMENTS

| | | | | |
|---|---|---|---|---|
| 3,103,897 | A * | 9/1963 | Bonanno | E01H 8/10 104/279 |
| 3,631,636 | A | 1/1972 | Nadolny | |
| 3,789,768 | A | 2/1974 | Broz | |
| 5,816,168 | A | 10/1998 | Poissant | |
| 6,758,145 | B1 * | 7/2004 | Hefter | A63H 19/15 104/279 |
| 7,597,049 | B2 * | 10/2009 | Leonowicz | E01B 31/02 104/DIG. 1 |
| 8,371,229 | B1 * | 2/2013 | Sailor | E01H 8/00 104/279 |
| 2006/0196386 | A1 * | 9/2006 | Mull | A63H 19/15 104/279 |

FOREIGN PATENT DOCUMENTS

| | | | | |
|---|---|---|---|---|
| DE | 3426626 | A1 * | 1/1986 | A63H 19/15 |
| DE | 4411464 | A1 * | 10/1994 | A63H 19/15 |
| GB | 2174630 | A * | 11/1986 | A63H 19/15 |

* cited by examiner

*Primary Examiner* — Zachary L Kuhfuss
(74) *Attorney, Agent, or Firm* — Dunlap Bennett & Ludwig PLLC

(57) ABSTRACT

A slot car track cleaner is provided. The slot car track cleaner includes a housing having at least an upper plate and a lower plate. A ledge may be disposed within the housing. The present invention further includes a plurality of floating weights. The floating weights hang from the ledge. A bottom portion of each of the floating weights protrudes beyond the lower plate. Each of the floating weights slide upwards when a pressure is applied to the bottom portion. A vertical plate is secured to the housing. The vertical plate includes a bottom edge protruding from the housing beyond the lower plate. A cleaning pad is secured to a bottom surface of the lower plate and covers the bottom portions of the plurality floating weights and at least a portion of the bottom edge of the vertical plate.

11 Claims, 5 Drawing Sheets

SLOT CAR TRACK CLEANING DEVICE

CROSS-REFERENCE TO RELATED APPLICATION

This application claims the benefit of priority of U.S. provisional application No. 62/298,520, filed Feb. 23, 2016, the contents of which are herein incorporated by reference.

BACKGROUND OF THE INVENTION

The present invention relates to slot car tracks and, more particularly, to a slot car track cleaning device.

Slot cars have electric motors which propel the slot cars on the track. The track has a pair of parallel upraised conductors extending the length of the track connected to a source of electrical energy. Wipers extending from the bottom of the slot car contact the pair of conductors and route the electrical energy to the motor of the slot car.

After some use, the track tends to become dirty and this results in lost traction of the slot car. The track's electrical conductors are also adversely effected by the dirt, interfering with the electrical contact between the electrified rails and the car mounted contacts which ride on the rails. Currently, a cloth and optionally a solution may be used to clean the track by hand. It is a tedious job to clean these tracks by hand as there are often hard to reach areas due to distance, overpasses, etc. Normally, the track slot is rarely if ever cleaned, yet it can retain dirt and debris that can be redistributed onto the track, making the track more dirty or dirty again.

As can be seen, there is a need for an improved device for cleaning the slot car track.

SUMMARY OF THE INVENTION

In one aspect of the present invention, a slot car cleaner comprises: a housing comprising at least an upper plate, a lower plate and a ledge; a plurality of floating weights hanging from the ledge, wherein a bottom portion of each of the plurality of floating weights protrudes beyond the lower plate, wherein each of the plurality of floating weights slide upwards when a pressure is applied to the bottom portion; a vertical plate secured to the housing and comprising a bottom edge protruding from the housing beyond the lower plate, wherein the bottom edge comprises a width sized to fit within a track slot of a slot car track; and a cleaning pad secured to a bottom surface of the lower plate and covering the bottom portions of the plurality floating weights and at least a portion of the bottom edge of the vertical plate.

In another aspect of the present invention, a slot car cleaner comprises: a housing comprising at least an upper plate and a lower plate; a vertical plate secured to the housing and comprising a bottom edge protruding from the housing beyond the lower plate, wherein the bottom edge comprises a width sized to fit within a track slot of a slot car track; a cleaning pad secured to a bottom surface of the lower plate and covering at least a portion of the bottom edge of the vertical plate; and a pair of spring arms extending laterally from opposing sides of the housing, wherein the spring arms are biased downwards against the cleaning pad.

These and other features, aspects and advantages of the present invention will become better understood with reference to the following drawings, description and claims.

DETAILED DESCRIPTION OF THE INVENTION

Figure 1:
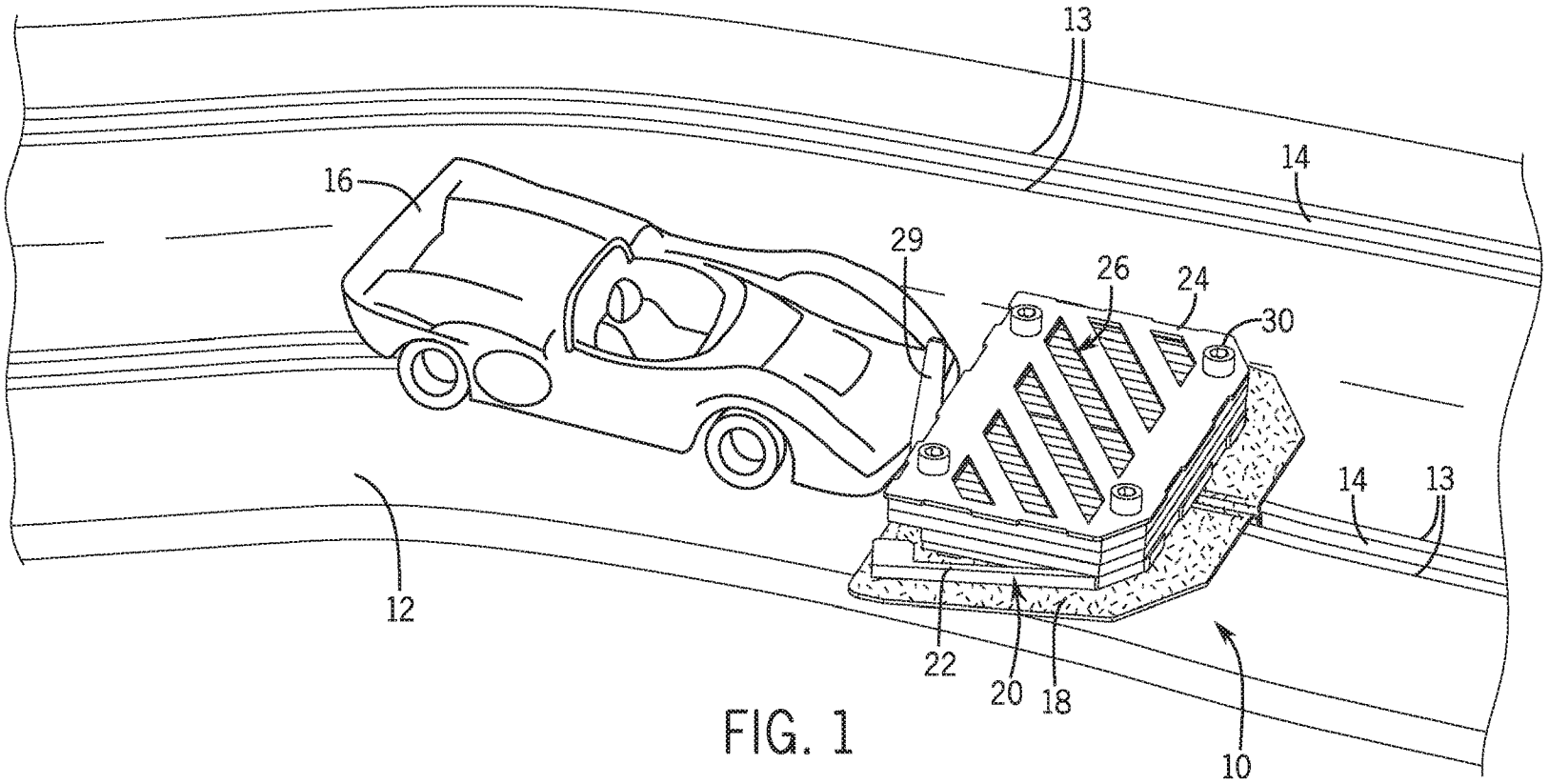
FIG. 1 is a perspective view of an embodiment of the present invention in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes an apparatus for cleaning a slot car track surface, the slot and the surface of the electrical conductors. The present invention is an apparatus that is set onto the slot car track and is then pushed with a slot car. The slot car is driven as it normally would be. The apparatus is equipped with material at the bottom that allows a thin cleaning cloth to be applied that serves as the means by which dust and debris are removed. The apparatus is made more effective because it is equipped with numerous rectangular weights which press down on the cloth such that the cloth contours to the variations in the track surface. Further, the present invention has the ability to adjust to varying track widths by using of side springs that keep the cleaning cloth as wide as possible, extending fully under normal use then retracting when an object such as a slot car fence results in obstructing part of the track width. Equipped with a track guide to keep the apparatus in the center of the lane being cleaned, the track guide cleans the track slot because the cleaning cloth surrounds the track guide.

The main frame may include a member to hold the weights used to contour the cleaning cloth to the track surface. The frame also includes the slot guide to keep the apparatus aligned and remain slotted as well as providing a means to clean the track slot. The frame may further include the side springs used to automatically adjust the cleaning width. Lastly, the frame includes hook material to allow for the cleaning cloth to adhere to. The top layer is a set of horizontal plates that encapsulated the contouring blocks.

The top plate holds the contouring weight blocks in place in conjunction with the other plates used to encapsulate them. The rectangular weights may be designed with two points at the bottom that concentrate downward pressure (equal to the downward force of the weights divided by the surface area of the points) onto the cloth to improve cleaning. They are designed to also provide some vertical movement of the blocks such that they each push down on the cloth independently to contour to the track surface. The blocks are designed with two lower touch points that increase downward pressure on the areas of the cloth they touch.

The present invention further results in improved rear tires or driven tires of the pushing slot car. This is because the added forces on the rear tires or driven tires of the slot car due to pushing the apparatus around the track helps remove dry rubber and debris. This conditions the rear tires in a way that improves their traction. The dry rubber and debris from the rear or driven tires are deposited onto the track subsequently removed by the cleaning device on the next lap.

Figure 2:
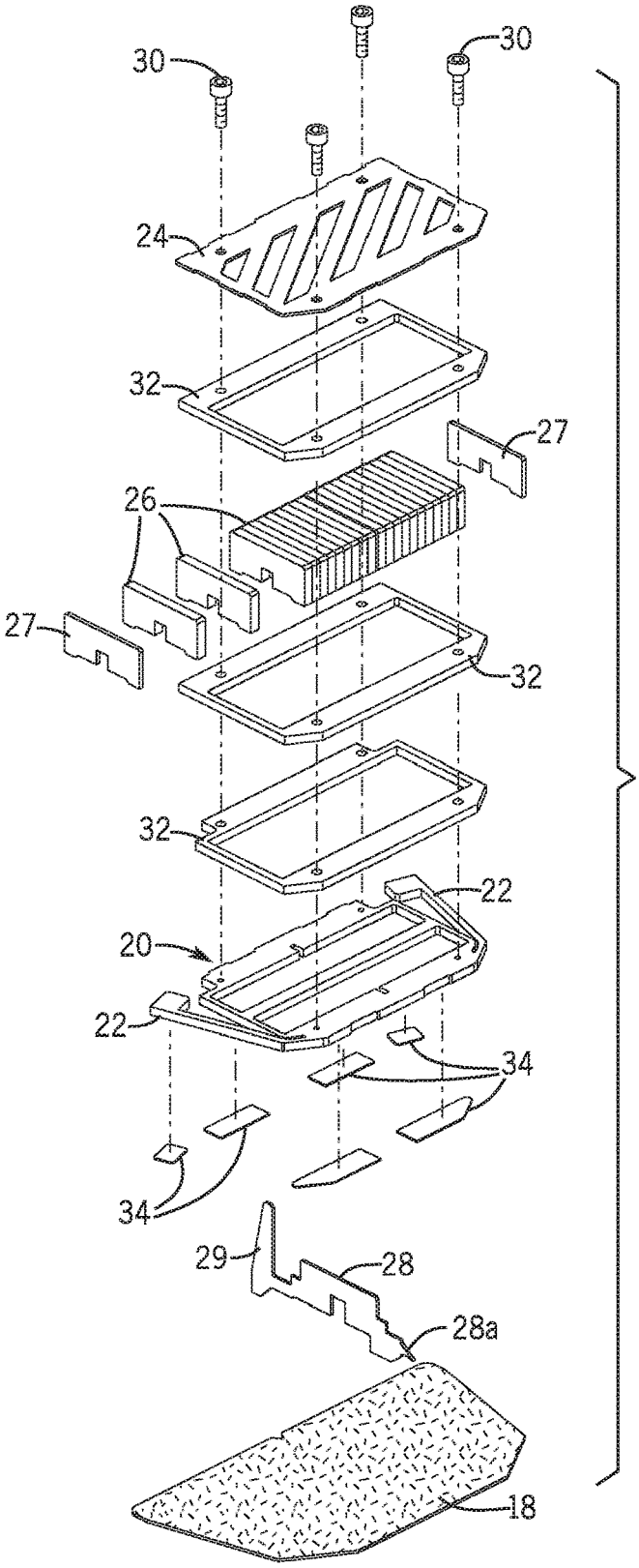
FIG. 2 is an exploded perspective view of an embodiment of the present invention.
Figure 3:
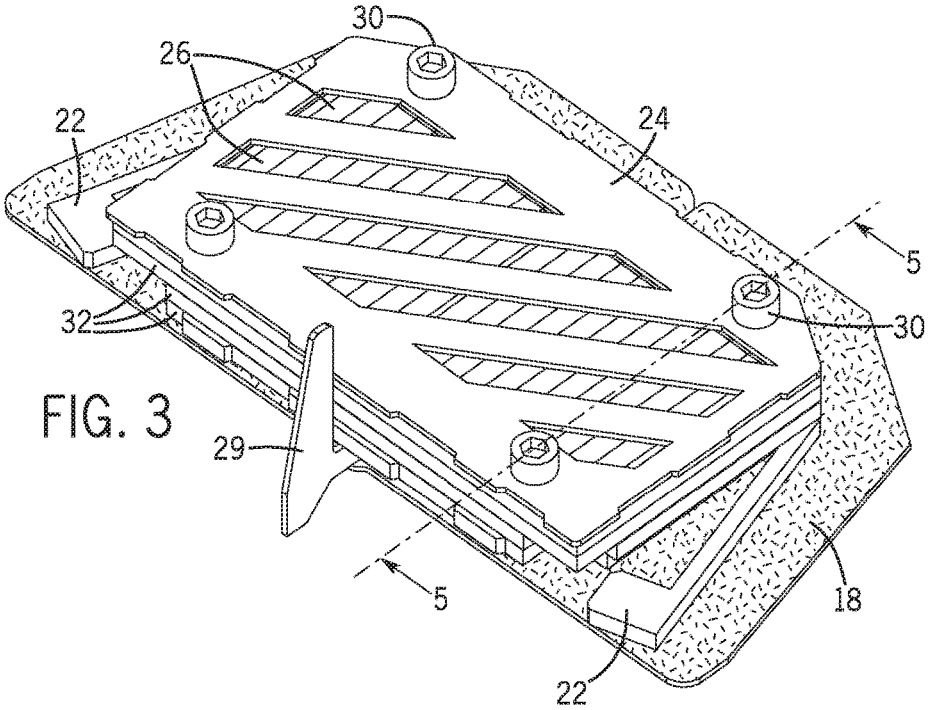
FIG. 3 is a top perspective view of an embodiment of the present invention.
Figure 4:
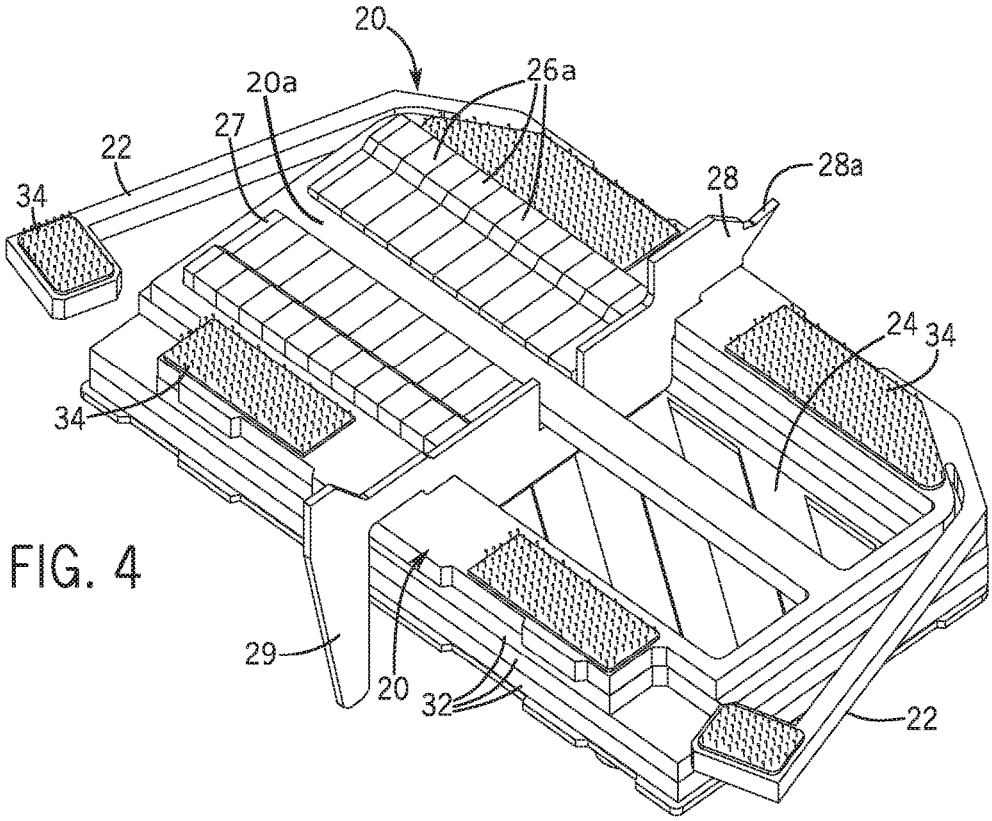
FIG. 4 is a bottom perspective of an embodiment of the present invention.
Figure 5:
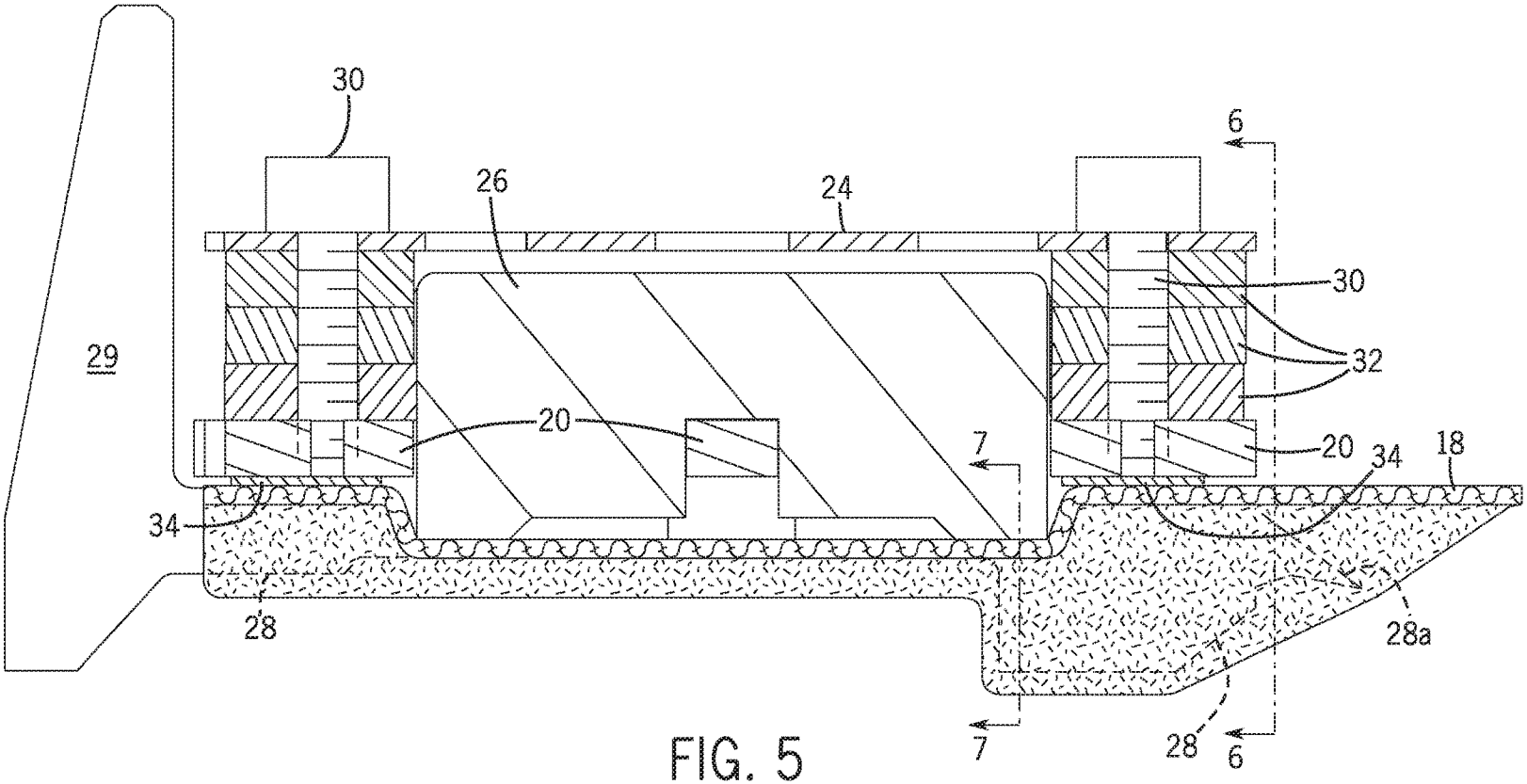
FIG. 5 is a cross-sectional view taken along line 5-5 of FIG. 3.
Figure 6:
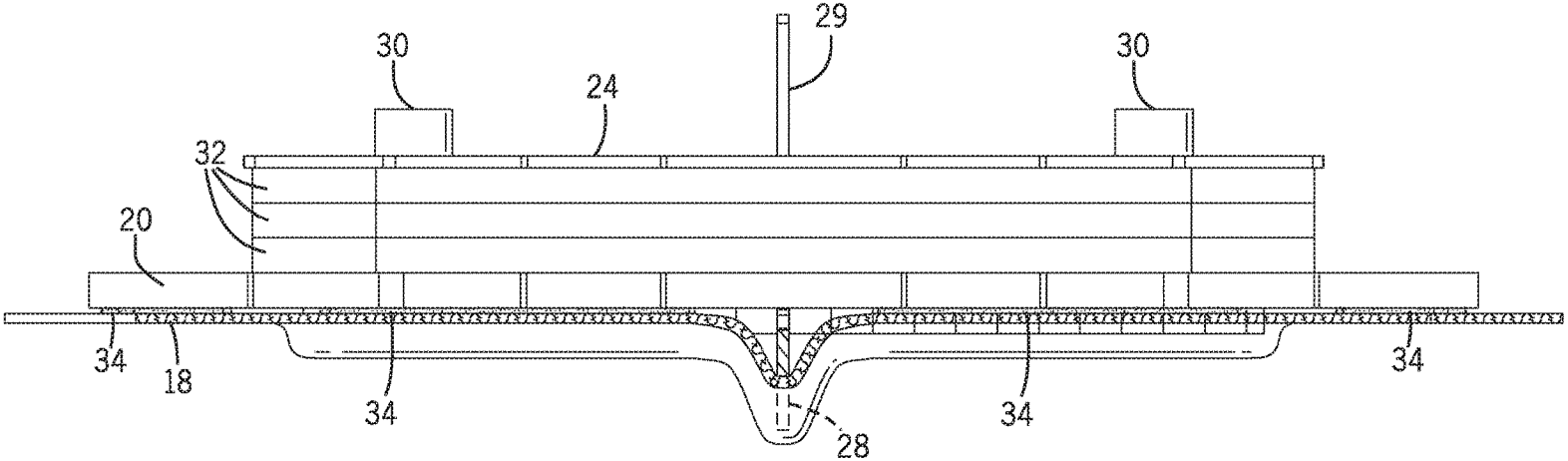
FIG. 6 is a cross-sectional view taken along line 6-6 of FIG. 5.
Figure 7:
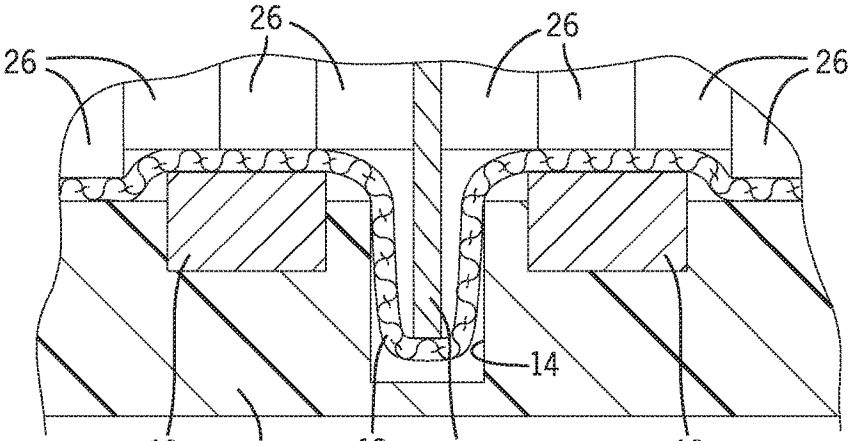
FIG. 7 is a cross-sectional view taken along line 7-7 of FIG. 5.

Referring to FIGS. 1 through 7, the present invention includes a slot car track cleaner. The slot car track cleaner includes a housing 10 having at least an upper plate 24 and a lower plate 20. A ledge 20*a* may be disposed within the housing 10. The present invention further includes a plurality of floating weights 26. The floating weights 26 hang from the ledge. A bottom portion of each of the floating weights 26 protrudes beyond the lower plate 20. Each of the floating weights 26 slide upwards when a pressure is applied to the bottom portion. A vertical plate 28 is secured to the housing 10. The vertical plate 28 includes a bottom edge protruding from the housing 10 beyond the lower plate 20. The bottom edge has a width sized to fit within a track slot 14 of a slot car track 12. A cleaning pad 18 is secured to a bottom surface of the lower plate 20 and covers the bottom portions of the plurality floating weights 26 and at least a portion of the bottom edge of the vertical plate 28.

In certain embodiments, the lower plate 20 includes an outer rim having a first side opposite a second side, and a front side opposite a rear side. An opening is formed in between the outer rim forming a clearing for the bottom portion of the floating weights 26. In such embodiments, the ledge 20*a* or center beam may extend transversely from the first side to the second side. Each of the floating weights 26 may include a slot formed through a central portion. The floating weights 26 may rest on the ledge 20*a* such that the ledge 20*a* is disposed within the slots. The floating weights 26 may further include a front protrusion 26*a* and a rear protrusion 26*a* protruding beyond a bottom of the ledge 20*a*. The front and rear protrusions 26*a* create two pressure points that concentrate pressure against the cloth 18 and track 12, thereby improving the cleaning effectiveness. In certain embodiments, the present invention may further include shims 27 disposed in between the floating weights 26 and the outer rim so that the floating weights 26 are stacked closely together.

The housing 10 may further include body plates 32 and the upper plate 24. The body plates 32 may each include the same shape as the lower plate 20, with an outer rim having a first side opposite a second side, and a front side opposite a rear side and an opening is formed in between the outer rim. The body plates 32 may be stacked on top of the lower plate 20 and the upper plate 24 may be stacked on top of the body plates 32. A space is formed in between the plurality of floating weights 26 and the upper plate 24 allowing the floating weights 26 to slide upwards and back downwards. In such embodiments, each of the plates 20, 24, 32 may include aligning apertures. Bolts 30 may run through the aligned apertures, securing the plates 20, 24, 32 together. The bolts 30 may be removed to separate the plates 20, 24, 32 and access the internal floating weights 26.

The vertical plate 28 of the present invention acts as a vertical track guide to keep the apparatus positioned on the track 12 and to also serve to clean the track slot 13. The vertical plate 28 may include a slot that is disposed within the ledge 20*a*. The vertical plate 28 may further include a pushing end 29 and prong end 28*a*. The pushing end 29 protrudes beyond a rearward portion of the housing 10 and extends upwards towards the upper plate 24. The slot car 16 may abut against the pushing end 28*a* when pushing the slot car track cleaner around the track 12. The pushing end 28*a* acts as an energy absorbing bumper when the slot car makes 16 contact. The pushing end 28*a* is angled to place some downward pressure on the cleaning pad 18 which helps keep the cleaning pad 18 flat. Further, the pushing end 28*a* is designed with a height that allows for a wide range of slot car bumper or front edge heights of the slot car 16. The prong end 28*a* extends beyond a forward portion of the housing and downwards away from the lower plate. The prong end 28 may form a point.

The present invention may further include a pair of spring arms 22 extending laterally and biased away from opposing sides of the housing 10. Each spring arm 22 may include an elongated flexible spring having a first end and a second end. The first end may be secured near a forward end of the housing 10 and the spring arm 22 may angle away from the side of the housing as it protrudes towards the rearward end of the housing 10. Therefore, the pair of spring arms 22 form angled protrusions that bend inwards towards the housing 10 as they pass by narrow areas of the track 12.

The cleaning pad 24 of the present invention may be made of a fabric material. The fabric material may be treated with a solution to aid with the cleaning of the tack slot 13, the track rails 14 and the track surface. In certain embodiments, a hook and loop connector 34 is adhered to a bottom surface of the lower plate 20. The hook and loop connector 34 may be in the form of patches with a plurality of hooks. In certain embodiments, a hook and loop connector 34 patch may be adhered to a bottom portion of each of the spring arms 22. The hooks may releasably attach to the cleaning pad 24. Therefore, the cleaning pad 24 may be removable from the bottom surface of the lower plate 20.

A method of using the present invention may include the following. A person who wishes to clean a slot car track to improve the performance of the track and one or more slot cars would apply an appropriately trimmed cleaning cloth to the bottom of the slot car track cleaner. In certain embodiments, the present invention includes a cloth cutting template, allowing users to cut an appropriately sized cloth to be used with the clot car track cleaner. The slot car track cleaner is then placed on the track so that the bottom edge of the vertical plate is within the slot of the track. Place a slot car capable of pushing the slot car track cleaner directly behind the slot car track cleaner. Then drive the slot car, pushing the slot car track cleaner around the track for one or more laps. The cloth may be replaced with clean cloth to remain effective. Once the track is cleaned, the driver will experience improved track performance as a result of better traction and improved electrical conductivity of the track conductors. In addition, the slot car used to push the apparatus around the track will perform better after the track is cleaned because it will have experienced improved rear or driven tires, with improved traction.

It should be understood, of course, that the foregoing relates to exemplary embodiments of the invention and that modifications may be made without departing from the spirit and scope of the invention as set forth in the following claims.

What is claimed is:

1. A slot car track cleaner comprising:

a housing comprising at least an upper plate, a lower plate and a ledge;

a plurality of floating weights hanging from the ledge, wherein a bottom portion of each of the plurality of floating weights protrudes beyond the lower plate, wherein each of the plurality of floating weights slide upwards when a pressure is applied to the bottom portion;

a vertical plate secured to the housing and comprising a bottom edge protruding from the housing beyond the lower plate, wherein the bottom edge comprises a width sized to fit within a track slot of a slot car track; and a cleaning pad secured to a bottom surface of the lower plate and covering the bottom portions of the plurality floating weights and at least a portion of the bottom edge of the vertical plate.

2. The slot car track cleaner of claim 1, wherein the lower plate comprises the ledge and each of the plurality of floating weights comprise a slot, wherein the ledge is disposed within the slots.

3. The slot car track cleaner of claim 1, wherein the vertical plate comprises a pushing end protruding beyond a rearward portion of the housing and extending upwards towards the upper plate.

4. The slot car track cleaner of claim 1, wherein the vertical plate comprises a prong extending beyond a forward portion of the housing and downwards away from the lower plate.

5. The slot car track cleaner of claim 1, further comprising a pair of spring arms extending laterally and biased away from opposing sides of the housing.

6. The slot car track cleaner of claim 1, further comprising a hook and loop connector adhered to a bottom surface of the lower plate, wherein the cleaning pad releasably attaches to the hook and loop connector.

7. The slot car track cleaner of claim 1, wherein a space is formed in between the plurality of weights and the upper plate.

8. The slot car track cleaner of claim 1, wherein the upper plate and the lower plate are releasably secured together by bolts running through aligned openings.

9. The slot car track cleaner of claim 1, wherein each of the plurality of floating weights comprises a first protrusion at a front portion and a second protrusion at a rear portion each applying a pressure against the cleaning pad.

10. The slot car cleaner of claim 1, wherein the vertical plate comprises a pushing end and a prong end, wherein the pushing end protrudes beyond a rearward portion the housing and extends upwards towards the upper plate and the prong end extends beyond a forward portion of the housing and downwards away from the lower plate.

11. A slot car track cleaner comprising:

a housing comprising at least an upper plate and a lower plate;

a vertical plate secured to the housing and comprising a bottom edge protruding from the housing beyond the lower plate, wherein the bottom edge comprises a width sized to fit within a track slot of a slot car track;

a cleaning pad secured to a bottom surface of the lower plate and covering at least a portion of the bottom edge of the vertical plate; and a pair of spring arms extending laterally and biased away from opposing sides of the housing.

* * * * *